United States Patent [19]

Cuntze et al.

[11] 4,095,941

[45] Jun. 20, 1978

[54] FIBER PREPARATION AGENTS TO PRODUCE A MARKED SEPARATING CAPABILITY

[75] Inventors: Ulrich Cuntze, Hofheim, Taunus; Gustav Dollinger, Egelsbach; Rolf Kleber, Neu-Isenburg, all of Germany

[73] Assignee: Hoechst Aktiengesellschaft, Frankfurt am Main, Germany

[21] Appl. No.: 618,055

[22] Filed: Sep. 30, 1975

[30] Foreign Application Priority Data

Oct. 4, 1974 Germany ..... 2447410

[51] Int. Cl.[2] ..... D06D 3/00; D06D 5/00

[52] U.S. Cl. ..... 8/18 A; 252/8.8

[58] Field of Search ..... 8/18, 18 A; 252/8.8; 156/331

[56] References Cited

U.S. PATENT DOCUMENTS

| | | | |
|---|---|---|---|
| 2,267,965 | 12/1941 | Wilson | 252/8.8 UX |
| 2,355,837 | 8/1944 | Wilson | 252/8.8 |
| 2,874,074 | 2/1959 | Johnson | 252/8.8 |
| 3,689,424 | 9/1972 | Berg et al. | 252/8.8 |
| 3,704,228 | 11/1972 | Eckert et al. | 252/8.8 |
| 3,925,012 | 12/1975 | Ringel et al. | 8/169 |

OTHER PUBLICATIONS

Speel et al. Textile Chem. & Auxiliares (1958) Reinhold Publ. Co. pp. 401-402.

*Primary Examiner*—William E. Schulz
*Attorney, Agent, or Firm*—Connolly and Hutz

[57] ABSTRACT

A process for the manufacture of synthetic staple fibers having a marked separating capability by preparing the synthetic fibers with fatty acid-amine-condensation products, which comprises preparing or conditioning the fibers, prior to the textile spinning processes, with fatty acid-hydroxy-alkyl-ethylene-diamine condensation products, the hydroxyalkyl radical or which shows 2 or 3 carbon atoms, and 1 to 2 identical or different radicals of saturated fatty acids having from 14 to 18 carbon atoms are present per mole of hydroxy-alkyl-ethylene-diamine.

12 Claims, No Drawings

FIBER PREPARATION AGENTS TO PRODUCE A MARKED SEPARATING CAPABILITY

The present invention relates to fiber preparation agents to produce a marked separating capability.

Great demands are made on preparations for staple fibers on the basis of synthetic fibers, since not only the running behavior on the aggregates is to be improved, and the yellowing of the fiber as well as the corrosion of the aggregates are to be avoided, but also the separation of the fibers, for example, on beating mills, is to be obtained (Lindner, Textilhilfsmittel und Waschrohstoffe, vol. II (1964), page 1601). The products used so far for this purpose, such as lauryltrimethyl-ammonium-chloride, soaps having a straight fat chain, primary fatty alcohol sulfates and fatty acid condensation products are not satisfactory, as they result either in a yellowing of the fibers or in an electrostatic charge, or cause an unsatisfactory running behavior, or they can only be used in strongly diluted solutions due to their pasty or wax-like consistency, which solutions can only be applied by being boiled with water.

It has now been found that synthetic staple fibers having a marked separating capability can be obtained by treating the synthetic fibers with fatty acid-amine-condensation products, if the fibers are prepared and/or conditioned (brightened), prior to the textile spinning processes, with fatty acid-hydroxyalkyl-ethylene-diamine-condensation products, the hydroxyalkyl radical of which shows 2 or 3 carbon atoms, and 1 to 2 identical or different radicals of saturated fatty acids having from 14 to 18 carbon atoms are present per mole of hydroxyalkyl-ethylene-diamine.

The condensation products to be used according to the invention can be converted into slightly liquid to pasty aqueous formulations which are in any case easily soluble in cold water. The invention therefore provides also liquid aqueous emulsions for carrying out the process of the invention, which emulsions contain from 20 to 40% by weight of fatty acid-hydroxyalkyl-ethylene-diamine-condensation products, the hydroxyalkyl radical of which has 2 or 3 carbon atoms, and 1 to 2 identical or different radicals of saturated fatty acids having from 14 to 18 carbon atoms are present per mole of hydroxyalkyl-ethylene-diamine.

The condensation products of the invention contain preferably from 1.2 to 1.8, in particular from 1.3 to 1.5 fatty acid radicals per mole of hydroxyalkyl-ethylene-diamine. The condensation products on the basis of stearic acid and hydroxyethyl-ethylene-diamine have been found to be particularly suitable.

The liquid formulations to be used according to the invention are prepared suitably in accordance with the following method:

The fatty acid and/or a lower fatty acid-alkylester, in particular a methyl ester, is reacted with the hydroxyalkyl-ethylene-diamine in the desired molar ratio, at a temperature of from 140° to 250° C, preferably from 160° to 220° C. Subsequently the pH of the reaction product is adjusted to a slightly acid value by means of a water-soluble organic or inorganic acid, preferably formic acid, acetic acid, oxalic acid, glycolic acid, phosphoric acid or sulfuric acid, and the hot melt is introduced, while stirring, into hot water. The proportions are suitably chosen in such a manner that the liquid emulsions obtained in this process contain from 20 to 40% by weight of active ingredient.

It is also possible, although not a preferred variant, to prepare the condensation products in a different way, for example, by acylating ethylene-diamine in the desired molar ratio with fatty acid and/or an activated fatty acid derivative, for example, fatty acid halides, and subsequently introducing the hydroxyalkyl group according to a known method, for example by a reaction with an alkylene oxide.

The preparation agents of the invention impart to the fiber which has been finished with them, not only the necessary good running behavior and the desired separating capability, by which process the fiber does not show any yellowing, nor do the aggregates show any corrosion, but they also impart to the fiber which has been finished accordingly, a pleasant and soft feel. With regard to their application, it is an advantage that the compounds are well soluble in cold water, that they can be converted into concentrated liquid formulations, and that they are well compatible, as non-ionic compounds, with other auxiliaries.

The preparation agents of the invention may also be applied advantageously onto the flock before spinning, for example, in the case of the polyacrylonitrile fiber flock, they can be applied already in the dye bath. The application is also possible in the continuous dyeing of polyacrylonitrile yarn for stretch breaking; in this process the high-bulk polyacrylonitrile yarn for stretch breaking obtains, besides the desired soft woolly feel, the increased separating capability which is required for an unobjectionable separation of the fibers. In this case the application is suitably effected after the dyeing. For the treatment of polyacrylonitrile fibers in the form of flocks or yarn for stretch breaking, the preparation agents of the invention are generally used in an amount of from 0.2 to 4% by weight, preferably from 0.5 to 2% by weight, calculated on the fiber weight. Due to the good compatibility, a combination with other agents for after-treatment, for example cationic anti-static agents, is possible.

In the fiber production it is recommended to use the preparation agents of the invention as a so-called final conditioning before the crimping chamber, in order to obtain a good separation of the fibers of the cut flock, for example, on the beating mill. The preparation agents for wool types of fiber, in particular those for the manufacture of carpets, are advantageously used in cases, where a particularly good separation of the fiber is required. As final conditioning, a coating amount of from 0.05 to 0.5% by weight, advantageously from 0.15 to 0.3%, calculated on the fiber weight, is used. For polyamide-6 and polyamide 6.6 carpet titer, a small amount of coating of about 0.07 to 0.2% by weight has been found to be advantageous. In all cases, the preparation agents of the invention may be used by themselves or in combination with other preparation agents, such as antistatic anionic phosphoric acid esters or cationic preparation agents.

After products have been used so far which show a pronounced dipolar character, in order to obtain a good separation capability, which products contain a water-solubilizing group in the molecule, besides a long-chain alkyl radical, it was a surprising fact which could not have been foreseen that the preparation agents to be used according to the invention, which do not show a pronounced dipolar character, impart to the staple fiber finished with these agents such a marked separation capability.

The following Examples serve to illustrate the invention; the percentages and ratio figures are by weight, unless otherwise stated.

EXAMPLE A

162 Grams (0.7 mole) of stearic acid and 52 g (0.5 mole) of hydroxyethylethylene-diamine were condensed for 8 hours at 180° C under a nitrogen atmosphere. The mixture was cooled to 90° C, and a yellowish product was obtained (base-nitrogen content 0.9%, acid number 2.0), which was adjusted to a pH value of 5.5 by means of acetic acid and which was stirred into 445 ml of water having a temperature of 80° C. A white liquid paste was obtained which was soluble in cold water and which had a solid matter content of 30%.

EXAMPLE B

243 Grams (0.9 mole) of stearic acid and 52 g (0.5 mole) of hydroxyethylethylene-diamine were condensed for 10 hours at 160° C under nitrogen atmosphere. The mixture was cooled to 90° C, and a yellowish product was obtained (base-nitrogen content 0.8%, acid number 1.5), which was adjusted to a pH value of 5.5 by way of acetic acid and which was stirred with 610 ml of water of 80° C. A white liquid paste was obtained, which was soluble in cold water and which showed a solid matter content of 30%.

EXAMPLE C

216 Grams (0.8 mole) of stearic acid and 52 g (0.5 mole) of hydroxyethylethylene-diamine were condensed for 10 hours at 160° C under a nitrogen atmosphere. The mixture was cooled to 90° C, and a yellowish product was obtained (base-nitrogen content 1.8%, acid number 7.5), which was adjusted to a pH value of 5.5 by means of oxalic acid and which was stirred into 580 ml of water having a temperature of 80° C. A white liquid paste was obtained, which was soluble in cold water and which showed a solid matter content of 28%.

EXAMPLE D

120 Grams (0.5 mole) of stearic acid and 52 g (0.5 mole) of hydroxyethylethylene-diamine were condensed for 8 hours at 180° C under a nitrogen atmosphere. The mixture was cooled to 90° C, and a yellowish product was obtained (base-nitrogen content 3.0%, acid number 1.3), which was adjusted to a pH value of 5.5 by means of acetic acid and which was stirred with 515 ml of water of 80° C. A white liquid paste was obtained, which was soluble in cold water and which had a solid matter content of 30%.

EXAMPLE 1

Polyamide-6 filaments (dtex 220 f 40) were treated with aqueous solutions of the following products, in which process a coating formulation containing 0.5% of active substance, calculated on the fiber weight, was applied in each case:

a. Product of Example A;

b. comparison product I (30% paste of a stearic acid-triethanol-amine-ester reacted with 1 mole of ethylene-oxide);

c. comparison product II (50% paste of a reaction product of stearic acid and triethylene-tetramine permethylated with dimethylsulfate).

The following effects were measured:

The dynamic friction, determined according to the process specified in the German patent specification No. P 24 16 430.5 (draw-off rate: 20 and/or 100m/minute):

a. 0.43 / 0.51
b. 0.40 / 0.45
c. 0.45 / 0.53;

the static thread/thread friction, determined according to the process specified in the German patent application No. P 24 16 430.5 (as a measurement for the separating capability):

a. 0 (very good)
b. 6 (moderate)
c. 7 (poor);

antistatic values (resistance measurement) at about 65% of relative humidity and at a temperature of 22° C:

a. 19 Meg-Ohm
b. 1000 Meg-Ohm
c. 10 Meg-Ohm;

solubility of the products in water at:

a. 20° C
b. 60° C
c. 90° C.

EXAMPLE 2

Polyamide-6 staple fibers (carpet type, 12 dtex, staple length 120 mm) were treated before the crimping process with the following products (0.21% of total active ingredient coating):

a. Product of Example B;

b. comparison product II, each in admixture with phosphoric acid - trilaurylester in a ratio of 2:1 (calculated on the active ingredient).

After conditioning, the crimped, dried and cut fibers showed a good drafting behavior on the carding machine, in which process the mixture a) of the invention yielded a card sliver without furls and naps, whereas the mixture b) showed indeed a good drafting behavior, but yielded a card sliver having numerous furls and naps.

EXAMPLE 3

A polyacrylonitrile yarn type for stretch-breaking (wetspun) was dyed continuously with a cationic dyestuff. After the steaming and the subsequent washings, the following after-treatment was carried out at 30° C in the last back-washing bath:

a. Product according to Example C;

b. product according to Example D;

c. mixture of comparison products I and II in a ratio of 1:1 (calculated on the active ingredient);

d. comparison product II.

Coating: 0.35% of active ingredient.

After the fibers had been separated subsequently on a breaking machine (type SEYDEL), the conditioning processes using the products (a) and (b) of the invention yielded a broken ribbon without column cracks and agglutinations which could then be processed without difficulty in spinning mills for worsted yarn. The comparative tests using the products (c) and (d) yield, in the breaking process, column cracks and a roll formation. In the subsequent stretching process there were to be found burls and drawing difficulties.

We claim:

1. A process for the lubrication of synthetic staple fibers to yield a low fiber cohesion which comprises applying onto the fibers prior to the textile spinning processes a condensation product obtained by condensation of 1.2 to 1.8 mols of a fatty acid having from 14 to 18 carbon atoms and 1 mol of hydroxy ethyl ethylene diamine or hydroxy propyl ethylene diamine.

2. A process as claimed in claim 1, wherein the synthetic fiber consists of polyacrylonitrile.

3. A process as claimed in claim 1, which comprises applying from 0.2 to 4% of condensation product, calculated on the fiber weight.

4. A process as claimed in claim 1, which comprises applying from 0.5 to 2% of condensation product, calculated on the fiber weight.

5. A process as claimed in claim 1, which comprises using the condensation products in dyeing or after-treatment baths.

6. A process as claimed in claim 1, wherein the synthetic fiber consists of polyamide.

7. A process as claimed in claim 1, which comprises applying from 0.05 to 0.5% of condensation product, calculated on the fiber weight.

8. A process as claimed in claim 1, which comprises applying from 0.07 to 0.3% of condensation product, calculated on the fiber weight.

9. A process as claimed in claim 1, which comprises applying from 0.05 to 0.5% of condensation products as final conditioners.

10. A process as claimed in claim 1, wherein the condensation product contains from 1.2 to 1.8 fatty acid radicals per mole of hydroxyalkyl-ethylene-diamine.

11. A process as claimed in claim 1, which comprises using a condensation product on the basis of 1 mole of hydroxyethyl-ethylene-diamine and from 1.3 to 1.5 moles of stearic acid.

12. Liquid aqueous emulsions for carrying out the process as claimed in claim 1 which contain from 20 to 40% by weight of a condensation product of 1.2 to 1.8 mols of a fatty acid with 14 to 18 carbon atoms and 1 mol of hydroxy ethyl ethylene diamine or hydroxy propyl ethylene diamine.

* * * * *